US005850721A

United States Patent [19]

Martin

[11] Patent Number: 5,850,721

[45] Date of Patent: Dec. 22, 1998

[54] JOIST BRIDGING

[75] Inventor: Wallace Martin, Langley, Canada

[73] Assignee: Cross Bridging Ltd., British Columbia, Canada

[21] Appl. No.: 866,500

[22] Filed: May 30, 1997

[51] Int. Cl.[6] ..... E04C 3/02

[52] U.S. Cl. ..... 52/690; 52/220.1; 52/696

[58] Field of Search ..... 52/633, 650.1, 52/695, 696, 729.1, 693, 690, 638, 220.1

[56] References Cited

U.S. PATENT DOCUMENTS

| | | | |
|---|---|---|---|
| 1,204,956 | 11/1916 | Day . | |
| 1,649,226 | 11/1927 | Gstalder . | |
| 3,991,535 | 11/1976 | Keller et al. | 52/690 X |
| 4,122,647 | 10/1978 | Kovar . | |
| 4,246,736 | 1/1981 | Kovar et al. . | |
| 4,336,678 | 6/1982 | Peters | 52/690 X |
| 4,794,746 | 1/1989 | Ramer . | |
| 4,947,612 | 8/1990 | Taylor et al. . | |
| 5,230,190 | 7/1993 | Schuette . | |
| 5,287,664 | 2/1994 | Schiller et al. . | |
| 5,301,486 | 4/1994 | Taylor . | |
| 5,519,977 | 5/1996 | Callahan et al. . | |
| 5,544,459 | 8/1996 | Konger . | |
| 5,546,716 | 8/1996 | Broxterman et al. . | |

*Primary Examiner*—Creighton Smith
*Attorney, Agent, or Firm*—Oyen Wiggs Green & Mutala

[57] ABSTRACT

A joist bridge has a web extending between a pair of end members. The web has a straight edge and an edge having a central indentation. The indentation provides a space through which plumbing pipes, electrical conduits and wiring and the like can be run. The joist bridge is economical of material and is therefore relatively inexpensive to manufacture. An adhesive strip may be provided along the top of the joist bridge to bond the joist bridge to the flooring above.

20 Claims, 4 Drawing Sheets

JOIST BRIDGING

FIELD OF THE INVENTION

This invention relates to joist bridges. Most particularly, the invention relates to joist bridges for bracing structural members such as joists and beams for supporting floors.

BACKGROUND OF THE INVENTION

Wood frame structures typically employ parallel wooden beams, or joists, as floor support members. To enhance the rigidity of such structures it is common to add braces between adjacent floor joists. The braces help to prevent the joists from twisting or bending. This, in turn, increases the load bearing capacity of the floors.

In their most primitive form, joist braces, or "bridges", consist of short sections of wooden stock nailed in criss-cross fashion between the top side of one joist and the bottom side of an adjoining joist, and vice versa. Such joist bridges suffer from the disadvantage that they are time consuming to install and their strength depends significantly on the care with which they are installed.

Pre-fabricated engineered joist bridges are becoming popular as replacements for nailed in bridges in some applications. The strength of a floor braced with properly installed pre-fabricated engineered joist bridges is typically greater and less variable than the strength of a floor braced with traditional cross braces Consequently, such floors can have greater spans than floors braced with traditional cross braces.

Some pre-fabricated joist bridges are described by: Taylor et. al., U.S. Pat. Nos. 4,947,612 and 5,301,486; Kovar, U.S. Pat. No. 4,122,647; Ramer, U.S. Pat. No. 4,794,746 discloses a cross-shaped bridge moulded from a single piece of plastic. All of these joist bridge members suffer from two disadvantages. First, they are expensive to manufacture. For example, the Taylor et al. bridges, which are wooden, should be made of expensive dried lumber having uniform characteristics. Consequently they are more expensive to use than traditional cross braces. This has prevented such joist bridges from gaining wide market acceptance.

A second problem with the cross type prior art joist bridges described above, including the traditional cross braces, is that cross type braces obstruct the channels between joists along which it is common to run plumbing, electrical conduits and heating ducts. Plumbers, electricians and heating installers will often knock out cross braces to enable them to install their pipes and ducts, thereby negating any benefit that might have been gained from the presence of the cross braces.

This second problem is partially addressed by the joist bridges disclosed in Schuette, U.S. Pat. No. 5,230,190, and Broxterman. U.S. Pat. No. 5,546,716. Schuette discloses a plastic joist bridge having a circular central aperture for receiving and supporting ducts. The joist bridge is suspended between two joists from a pair of tabs, one of which projects on top of each of the two joists. Broxterman et. al. discloses a sheet metal joist bridge comprising a circular central aperture for supporting ducts. The bridge has a span that may be varied to accommodate the distance between joists.

A disadvantage of the Broxterman et al. and Schuette joist bridges is that they may not provide a desired degree of structural reinforcement or "bracing" in some applications and they are significantly more expensive than traditional cross bridges.

Day, U.S. Pat. No. 1,204,956, Gestalder, U.S. Pat. No. 1,649,226 and Kovar et al. U.S. Pat. No. 4,246,736 describe some other alternatives to traditional wooden cross-braces.

SUMMARY OF THE INVENTION

The invention provides joist bridges which, when installed, provide an unobstructed run for plumbing pipes, electrical conduits and the like. A first aspect of the invention provides a joist bridge comprising: a web comprising a sheet of material having first and second sides first and second opposed ends, a generally straight first edge and a second edge opposed to the first edge and having a centrally located indentation; and, parallel end members extending along and affixed to each of the ends of the web, each of end members projecting flange like on each of the first and second sides of the web. The web preferably comprises a sheet of OSB material. The end members each preferably comprise a longitudinal groove and the opposed ends of the web are preferably each received in and affixed in the longitudinal groove of one of the end members. The opposed ends of the web are most preferably affixed in the grooves by an adhesive such as a compatible phenol resorcinol glue.

Another aspect of the invention provides a joist bridge comprising: a web of OSB material having a width in the range of about 12 inches to about 24 inches, a height in the range of about 7 inches to 12 inches and a thickness in the range of ½ inches to 1½ inches. The web has first and second sides first and second opposed ends, a generally straight first edge and a second edge opposed to the first edge and having a centrally located indentation. The second edge comprises a central concave region following an arc having a radius of curvature of about 2 inches to about 5 inches and a pair of convex knee regions on either side of the concave region each having a radius of curvature in the range of about 2 inches to about 5 inches. The joist bridge also comprises an end member extending substantially entirely along each of the opposed ends of the web and affixed to the web with an adhesive. Each end member comprises a longitudinal parallel-sided groove receiving a respective one of the opposed ends of the web. Each end member has a generally planar outer face parallel to the outer face of the other end member.

Yet another aspect of the invention provides a floor structure the floor structure comprises: a pair of adjacent parallel generally horizontal joists; and, a plurality of joist bridges extending transversely between the joists. The joist bridges each comprise: an upright web comprising a sheet of OSB material having first and second sides first and second opposed ends, a generally straight first edge and a second edge opposed to the first edge and having a centrally located indentation; and, parallel end members extending along and affixed to each of the ends of the web, each of end members projecting flange like on each of the first and second sides of the web. The end members each comprise a longitudinal groove which receives one of the opposed ends of the web. In one preferred embodiment, a floor material is disposed atop the joists and upper edges of each of the joist bridges are spaced apart from the floor material by gaps. In another preferred embodiment, one or more of the joist bridges is oriented with the second edge of the web uppermost and one or more of the joist bridges is oriented with the first edge of the web uppermost to provide an unobstructed run for pipes which must run at an angle.

A further aspect of the invention comprises a method of making joist bridges from a rectangular sheet of material. The method comprises the steps of: cutting the sheet into strips by making a plurality of cuts, the cuts comprising parallel sinuous cuts each following a curve having a wavelength substantially equal to the desired width of the joist bridges alternating with parallel straight cuts parallel to a side edge of the sheet; cutting each of the strips into web members by making a plurality of transverse cuts perpendicular to the direction of the straight cuts, each web member having first and second sides first and second opposed ends, a generally straight first edge and a second edge opposed to the first edge and having a centrally located indentation; and affixing an end member to each of the first and second opposed ends of each web member.

BRIEF DESCRIPTION OF THE DRAWINGS

In drawings which illustrate non-limiting embodiments of the invention.

DETAILED DESCRIPTION

Figure 1:
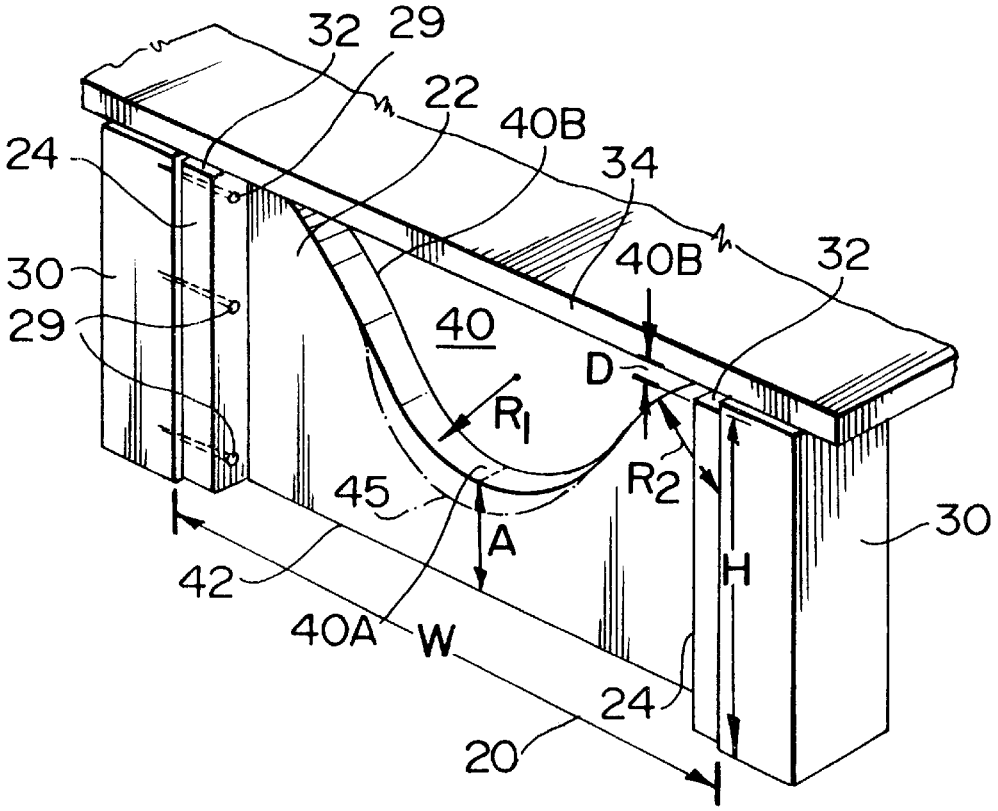
FIG. 1 is a front elevational view of a joist bridge according to the invention installed between a pair of joists.
Figure 2:
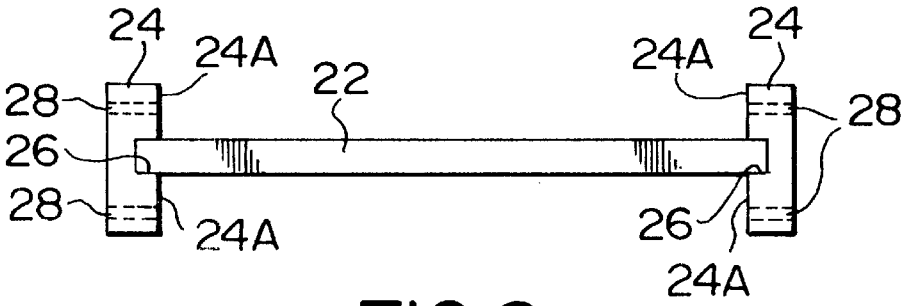
FIG. 2 is a top plan view of the joist bridge of FIG. 1.

As shown in FIG. 1, a joist bridge 20 comprises a generally planar web 22 mounted between a pair of end members 24. End members 24 have portions 24A which project flange-like on either side of web 22. Preferably end members 24 comprise grooves 26 which respectively receive either end of web 22. Web 22 is affixed in grooves 26 with a suitable adhesive, such as a compatible phenol resorcinol glue. Web 22 may be affixed to end members 24 with suitable fasteners such as screws.

End members 24 are preferably fabricated from wood, such as ¾ inch thick OSB or plywood. Web 22 is preferably fabricated from a sheet of oriented strand board ("OSB") or fiberboard of a suitable thickness. OSB is advantageous because its properties are consistent, it does not have a "grain" that could make it very weak in certain directions, and it is not prone to significant shrinkage. Joist bridges 20 manufactured from OSB are capable of having a very high and consistent racking stiffness which is highly desirable in joist bridges.

The thickness of plate member 22 will depend upon the dimensions and design of the floor in which joist bridges 20 are installed according to accepted engineering principles. In most typical applications with floor spans of less than 20 feet, the thickness of plate member 22 will be in the range of ½ inch to 1½ inches.

Joist bridge 20 is dimensioned to fit between joists 30 which are generally spaced apart by a standard distance. For example, in residential construction it is usual in many jurisdictions for floor joists to be installed on 16 inch centers. In this case, the space between the facing surfaces of adjoining joists is 14¼ inches and the width W of joist bridge 20 would be about 14¼ inches. Because joist bridges 20 are the correct width to fit between adjacent joists 30 they may be used as spacers to lay out joists 30 in new construction.

The height H of joist bridges 20 is preferably slightly less than the height of the joists being braced. For example, where the joists are nominally 2×10 boards, joist bridge 20 would have a height of about 9½ inches, which is ¼ inches less than the width of a finished 2 ×10 board. If joists 30 are not completely dry when they are installed (e.g. if joists 30 have a moisture content greater than about 19%) then they may shrink as they dry. Consequently it is desirable to leave a gap 32 between the uppermost portions of joist bridges 20 and the lower surface of flooring material 34 being supported by joists 30. Otherwise, the shrinkage of joists 30 could lift joist bridges 20 enough to distort flooring material 34. Typically the width D of gaps 32 should be about ¼ inch.

Web 22 has an indentation 40 on one side. When joist bridges 20 are installed, indentations 40 provide apertures which allow the passage of plumbing pipes, electrical conduits, heating ducts, and the like. Each indentation 40 preferably has a central curved portion 40A and curved knees 40B on either side. Most preferably, the edge of indentation 40 follows arcs of radius R. in each of curved portion 40A and curved knees 40B.

As shown in FIG. 1, indentation 40 is of a depth such that the narrowest section of web 22 has a depth A which is sufficient to provide a desired degree of rigidity of joist bridge 20. In a joist bridge 20 for installation between 2×10 joists in which web 22 comprises ¾ inch thick OSB dimension A should typically be about 3 inches. It is thought that the large, generally triangular, portions of web 22 on either side of indentation 40 contribute to the rigidity of floors which incorporate joist bridges 20 according to the invention.

Figure 8:
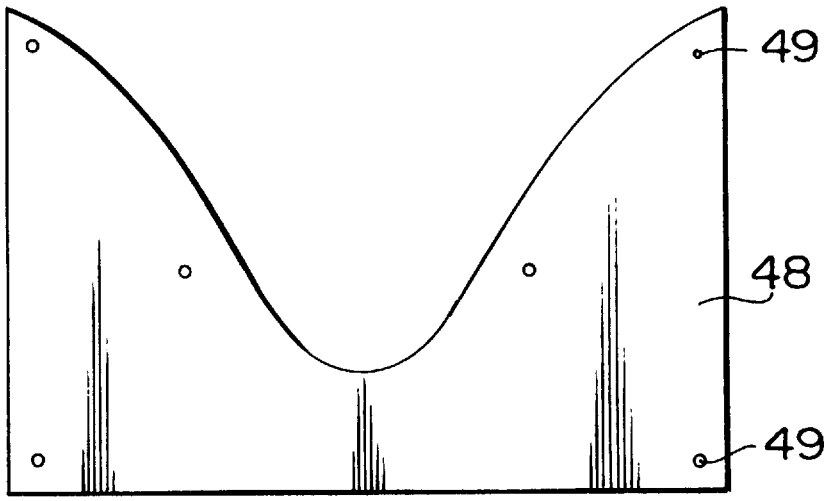

Most preferably joist bridges 20 are marked with a line 45 adjacent central curved portion 40A. If it is necessary to enlarge recess 40 than material can be cut away inside line 45. The racking stiffness of joist bridge 20 can then be restored by attaching a reinforcing member 48 to web 22. Line 45 establishes an area within which material can be cut away from web 22 without reducing the racking stiffness of joist bridge 20 to a point where the racking stiffness of joist bridge 20 cannot be restored to an acceptable value by attaching a reinforcing member 48 (FIG. 8). Reinforcing member 48 may be formed, for example, from a sheet of heavy gauge metal plate or a wooden sheet cut to fit snugly between end members 24. The upper edge of reinforcing member 48 is cut to generally follow line 45 and knees 40B. Preferably reinforcing member 48 has a number of holes 49 for receiving fasteners, such as nails or screws, for fastening reinforcing member 48 to a web 22 of a joist bridge 20.

End members 24 are preferably formed from OSB but may also be made of other suitable materials such as planking, plywood, or the like. Preferably, each end member 24 has a number of holes 28 for receiving fasteners 29 such as nails or screws for fastening joist bridge 20 between a pair of joists as shown in FIG. 4. Preferably, holes 28 are set at a slight angle outwardly from web 22 to facilitate the placement and driving in of fasteners 29. Holes 28 are preferably placed so that when two joist bridges 20 are attached on either side of a joist 30 (FIG. 3) the holes in the two joist bridges 20 are not aligned with one another.

Figure 7:
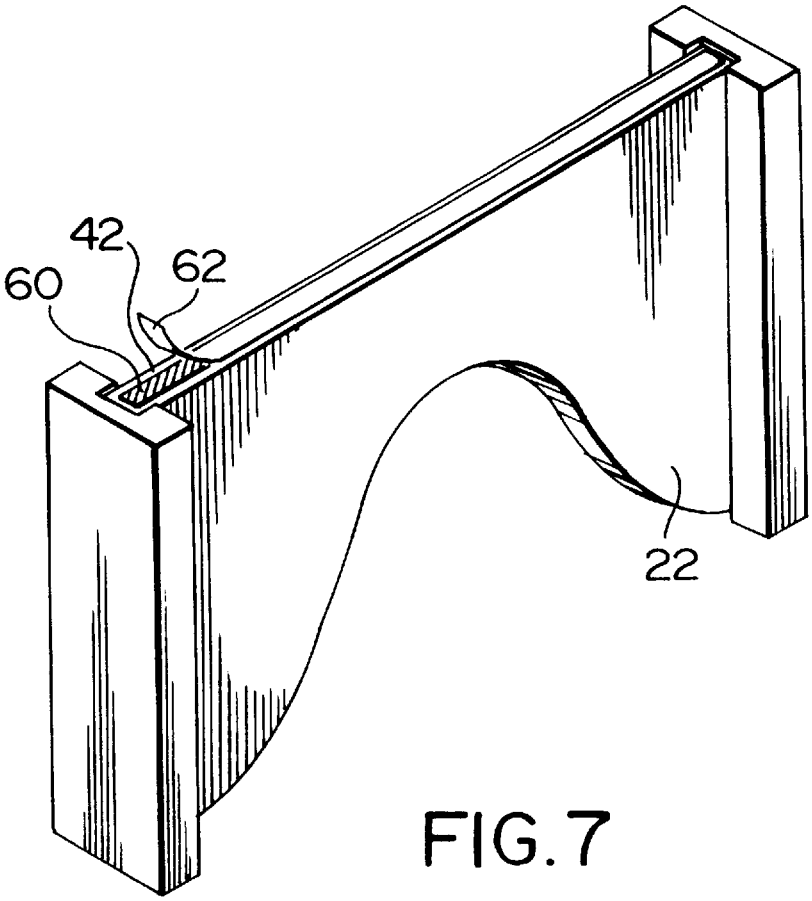
FIG. 7 is a perspective view of a joist bridge according to the invention equipped with a self-adhesive strip for fastening the joist bridge to a sub-floor; and, FIG. 8 is a front elevational view of a reinforcing member for use in the invention.

Joist bridges 20 may be installed with indentation 40 facing upwardly, as shown in FIG. 1, or with indentation 40 facing downwardly. If joists 30 are dry when joist bridges 20 are installed then the straight side 42 of web 22 may be installed flush with the tops of joists 30 and glued to the underside of floor material 34 with a suitable construction adhesive. This further increases the strength of the floor. An adhesive strip 60 covered by a removable release sheet 62 (see FIG. 7) may optionally be provided along the straight edges 42 of joist bridges 20. When it is desired to mount joist bridges 20 with straight edges 42 adhered to floor material 34 then release sheet 62 is removed. Adhesive strip 60 bonds joist bridge 20 to the underside of subfloor 54. This further increases the rigidity of the floor. The use of adhesive strips 60 obviates the need for fasteners for securing joist bridges 20 to subfloor 54 and the attendant difficulty of aligning fasteners with joist bridges 20 through floor material 34 after floor material 34 has been laid down.

Figure 3:
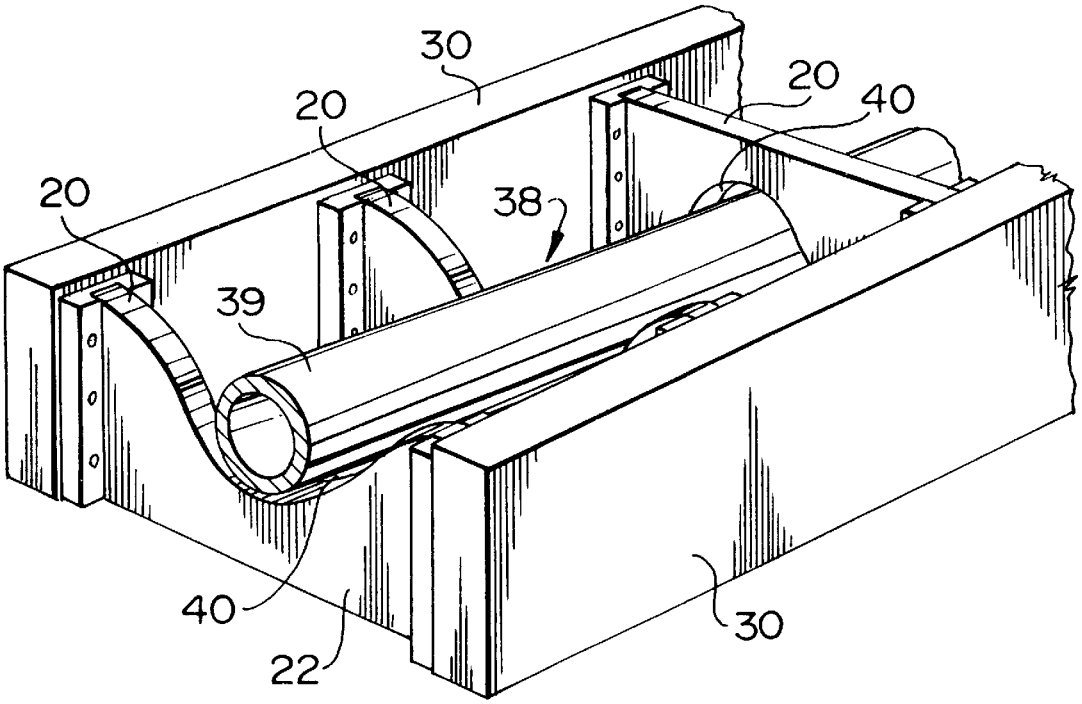
FIG. 3 is a perspective view of several joist bridges according to the invention installed between a pair of parallel joists to provide an unobstructed mechanical run.
Figure 4:
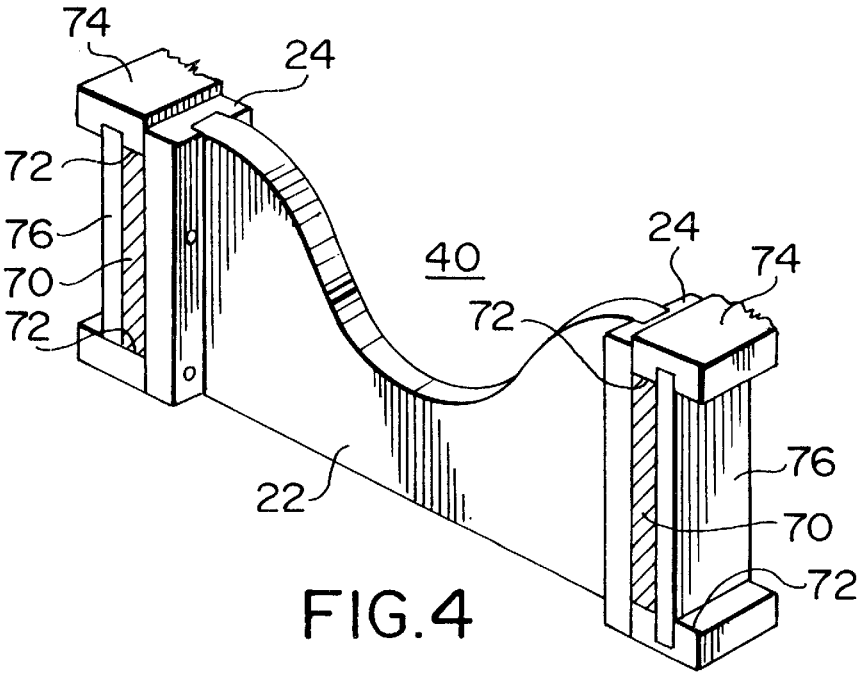
FIG. 4 is a front elevational view of an alternative embodiment of the joist bridge of the invention installed between a pair of I-beam type joists.

As is evident from FIG. 3, indentations 40 of a series of joist bridges 20 installed between adjacent joists 30 align in such a manner as to provide an unobstructed central corridor or run 38 for passing and supporting ducts, pipes, conduits or the like. Pipes must often be installed so that they slope gently over the lengths of their runs. As shown in FIG. 3, some of joist bridges 20 may be installed with indentations 40 facing upward and others of joist bridges 20 may be installed with indentations 40 facing downward to provide a run 38 capable of receiving a sloping pipe 39.

Preferably either transverse wooden straps or sheets of drywall material are affixed to the undersides of joists 30 after joist bridges 20 have been installed as this increases the rigidity of the floor.

In some new construction, I-type joists are being used in place of traditional flat sided joists. When joist bridges 20 are used with I-type joists then a projecting end piece 70 is preferably added to either end of each joist bridge 20 (FIG. 4). When joist bridge 20 is installed, end pieces 70 project between the flanges 72 of neighbouring I-type joists 74 to rest against the central webs 76 of I-type joists 74. End pieces 70 simply act as spacers having thicknesses equal to the distance from the web of the I-type joist to the outer edges of the top and bottom chords of the I-type joist.

Figure 5:
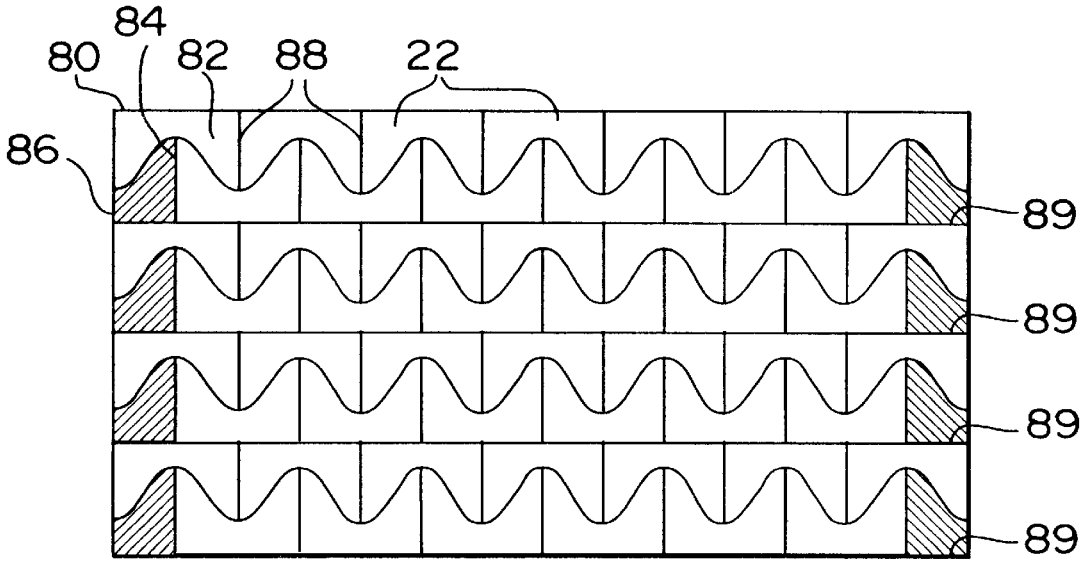
FIG. 5 is a plan view of a cutting pattern for cutting webs from is a sheet of material.

A particular advantage of joist bridges 20 as described above, is that they are extremely economical of materials. Such joist bridges can therefore be significantly less expensive than most prior art prefabricated joist bridges. As shown in FIG. 5, webs 22 for making joist bridges 20 may be cut from a sheet 80 of material such as OSB with minimal wastage. Sheet 80 is cut longitudinally into strips 82 along alternating sinuous lines 84 and straight lines 86. Strips 82 are then cut transversely along lines 88 to yield webs 22. Only a few waste portions 89 at either end of sheet 80 are created in this process. The amount of wastage can be minimized by using long sheets 80.

Figure 6:
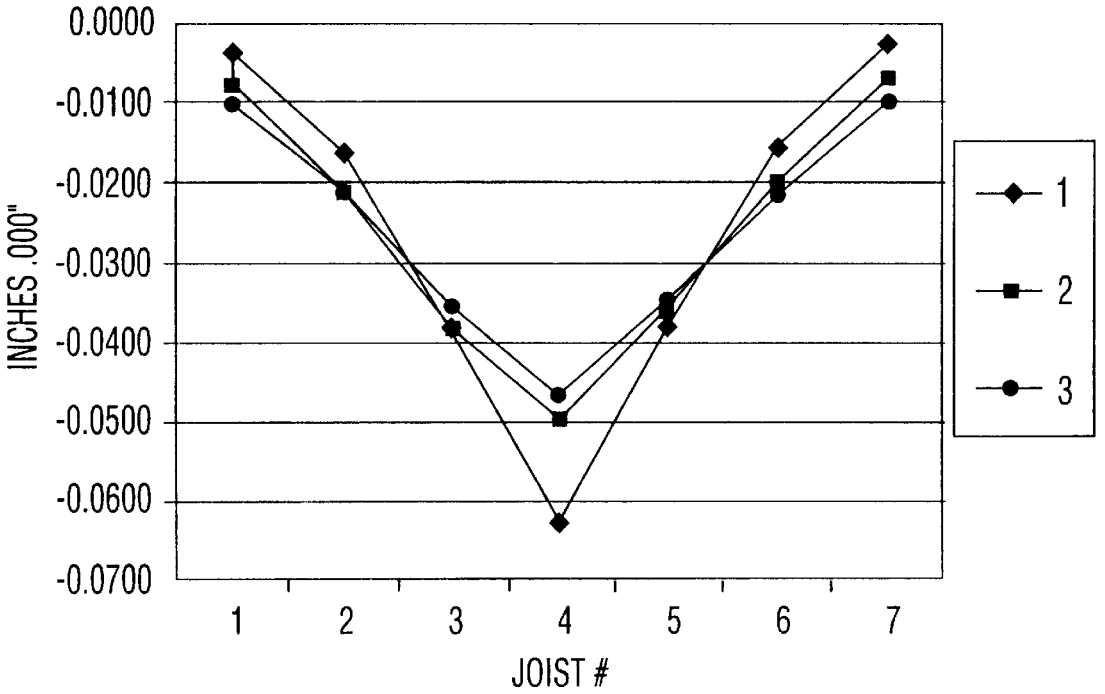
FIG. 6 is a graph of the deflection under load as a function of position for test floors incorporating different types of joist bridge.

FIG. 6 shows deflection as a function of position across a test floor under a load of 1 kiloNewton placed at the midpoint of a test test floor comprising 7 2×10 joists spaced apart by 16 inches, center-to-center. The test floor was constructed in compliance with the Technical Guide for Bridging for Floor Systems, Masterformat Section 06160 specification, published by the Canadian Construction Materials Centre of the National Research Council of Canada. An identical configuration was used for each type of joist bridge tested. From FIG. 6, it can be appreciated that joist bridges according to the invention (indicated by ●) perform significantly better (i.e. provide less deflection) than the conventional cross braces made from two by two lumber (indicated by ■) to which they were compared. A floor without cross braces at all (indicated by ♦) performed more poorly than either of the test floors equipped with cross braces.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A joist bridge comprising:

(a) a web comprising a sheet of material having first and second sides first and second opposed ends, a generally straight first edge and a second edge opposed to the first edge and having a centrally located indentation; and, (b) parallel end members extending along and affixed to each of the ends of the web, each of end members projecting flange like on each of the first and second sides of the web wherein the second edge comprises a central concave region following an arc between a pair of convex knee regions.

2. The joist bridge of claim 1 wherein the second edge follows arcs in the convex knee regions.

3. The joist bridge of claim 2 wherein radii of the arcs in the knee regions are equal to a radius of the arc in the concave region.

4. The joist bridge of claim 3 wherein the web comprises a sheet of OSB material.

5. The joist bridge of claim 4 wherein the end members comprise strips of OSB material.

6. The joist bridge of claim 5 further comprising an adhesive strip extending along the first edge of the web and covered with a sheet of release material.

7. The joist bridge of claim 1 comprising a cutting line generally following and spaced inwardly from the central concave region of the second edge, the joist bridge further comprising a reinforcing member attachable to the web, the reinforcing member comprising a sheet of material dimensioned to fit against the web between the end members, the reinforcing member having a side edge having a central portion wherein the side edge generally follows the cutting line.

8. The joist bridge of claim 1 wherein the web comprises a sheet of OSB material.

9. The joist bridge of claim 8 wherein the end members each comprise a longitudinal groove and the opposed ends of the web are affixed in the longitudinal groove of one of the end members.

10. The joist bridge of claim 9 wherein the opposed ends of the web are affixed in the longitudinal grooves by an adhesive.

11. The joist bridge of claim 10 wherein the adhesive is a compatible phenol resorcinol glue.

12. A joist bridge comprising:

(a) a web of OSB material having a width in the range of about 12 inches to about 24 inches, a height in the range of about 7 inches to 12 inches and a thickness in the range of ½ inches to 1½ inches, the web having first and second sides first and second opposed ends, a generally straight first edge and a second edge opposed to the first edge and having a centrally located indentation, the second edge comprising a central concave region following an arc having a radius of curvature of about 2 inches to about 5 inches and a pair of convex knee regions on either side of the concave region each having a radius of curvature in the range of about 2 inches to about 5 inches;

(b) an end member extending substantially entirely along each of the opposed ends of the web and affixed to the web with an adhesive, each end member comprising a longitudinal parallel-sided groove receiving a respective one of the opposed ends of the web, each end member having a generally planar outer face parallel to the outer face of the other end member.

13. A floor structure comprising:

(a) a pair of adjacent parallel generally horizontal joists;

(b) a plurality of joist bridges extending transversely between the joists, the joist bridges each comprising: A joist bridge comprising:

(i) an upright web comprising a sheet of OSB material having first and second sides first and second opposed ends, a generally straight first edge and a second edge opposed to the first edge and having a centrally located indentation;

(ii) parallel end members extending along and affixed to each of the ends of the web, each of end members projecting flange like on each of the first and second sides of the web, the end members each comprising a longitudinal groove which receives one of the opposed ends of the web.

14. The floor structure of claim 13 wherein one or more of the joist bridges is oriented with the second edge of the web uppermost and one or more of the joist bridges are oriented with the first edge of the web uppermost.

15. The floor structure of claim 13 wherein a floor material is disposed atop the joists and upper edges of each of the joist bridges are spaced apart from the floor material by gaps.

16. The floor structure of claim 13 wherein the joists comprise I-type joists each having a web portion extending between top and bottom chords and wherein each of the joist bridges has a member projecting from each of its end members to contact the web portion of an adjoining joist.

17. A method of making joist bridges from a rectangular sheet of material, the method comprising the steps of:

(a) cutting a rectangular sheet of material into strips by making a plurality of cuts, the cuts comprising parallel sinuous cuts each following a curve having a repeating pattern of a wavelength substantially equal to the desired width of the joist bridges alternating with parallel straight cuts parallel to a side edge of the sheet;

(b) cutting each of the strips into web members by making a plurality of transverse cuts perpendicular to the direction of the straight cuts, the transverse cuts located at wide portions of the strips, each web member having first and second sides first and second opposed ends, a generally straight first edge and a second edge opposed to the first edge and having a centrally located indentation; and (c) affixing end members to each of the first and second opposed ends of each web member.

18. A floor structure comprising:

(a) a pair of adjacent parallel generally horizontal joists;

(b) a plurality of joist bridges extending transversely between the joists, the joist bridges each comprising: A joist bridge comprising:

(i) an upright web comprising a sheet of material having first and second sides, first and second opposed ends, a generally straight first edge and a second edge opposed to the first edge and having a centrally located indentation;

(ii) parallel end members extending along and affixed to each of the ends of the web, each of end members projecting flange like on each of the first and second sides of the web, the end members each comprising a longitudinal groove which receives one of the opposed ends of the web.

19. A joist bridge comprising:

(a) a web comprising a sheet of material having first and second sides, first and second opposed ends, a generally straight first edge and a second edge opposed to the first edge, the first and second ends having a height and being spaced apart by a width, the width being greater than the height;

(b) parallel end members extending along and affixed to each of the ends of the web, each of the end members projecting outwardly on each of the first and second sides of the web;

wherein a central portion of the second edge is indented by an indentation, the indentation having a depth sufficient to completely receive a standard plumbing pipe extending generally transversely to the sheet, and wherein, in the central portion, the second edge of the web is everywhere spaced apart from the first edge of the web by at least 3 inches.

20. The joist bridge of claim 19 wherein the sheet consists of a sheet of a wood material having a thickness of ¾ inches or more.

* * * * *